US006966462B1

(12) United States Patent
Torrence

(10) Patent No.: US 6,966,462 B1
(45) Date of Patent: Nov. 22, 2005

(54) SECURITY GLOVE

(76) Inventor: Domonique Torrence, 3991 Habana Ave., Jacksonville, FL (US) 32217

( * ) Notice: Subject to any disclaimer, the term of this patent is extended or adjusted under 35 U.S.C. 154(b) by 0 days.

(21) Appl. No.: 11/011,849

(22) Filed: Dec. 14, 2004

(51) Int. Cl.[7] ..... B67D 5/64
(52) U.S. Cl. ..... 222/175; 2/160
(58) Field of Search ..... 222/175; 2/160

(56) References Cited

U.S. PATENT DOCUMENTS 4,037,790 A * 7/1977 Reiser et al. ..... 222/175
4,504,980 A 3/1985 Butcher
4,625,339 A 12/1986 Peters
5,088,121 A 2/1992 Wallace
5,484,085 A * 1/1996 Bennett ..... 222/175
5,538,164 A * 7/1996 Rivas ..... 222/175
5,943,701 A 8/1999 Seats

* cited by examiner

*Primary Examiner*—Philippe Derakshani
(74) *Attorney, Agent, or Firm*—Lawrence J. Gibney, Jr.

(57) ABSTRACT

This is a device, which will allow additional protection particularly for women by mounting a canister of mace or pepper spray on the top surface of the hand so that the spray can be released but at the same time not disable the woman's hand for personal defense.

6 Claims, 5 Drawing Sheets

SECURITY GLOVE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to security precautions particularly for women but this device may also be used for entertainment purposes.

B. Prior Art

One of the dangers, among women in particular, is going to and from automobiles in dimly lit or poorly lit areas such as malls and other outdoor venues. This would include any outdoor open spaces such as parks where unfortunately criminals may hide in waiting for their prey.

Some of the other representative examples to protect individuals include Seats, U.S. Pat. No. 5,943,701, Butcher, U.S. Pat. No. 4,504,980, and Wallace, U.S. Pat. No. 5,088,121.

All three devices try to achieve the same result although when the mace or pepper spray is inserted in a pocket in the palm of the hand or simply below the index finger it makes the hand non-functional and can lead to misfiring the mace or pepper spray.

The current device, however, will allow the person to use both hands to locate the car keys, cell phone or other defensive mechanism and then open the car door for example. It is simply slipped on and off the hand and is easily removed by the person when the person is safely in the car. Unlike the other relevant prior art this device will allow the person to use both hands while still allowing the person to "aim" the pepper spray.

The Peters patent, U.S. Pat. No. 4,625,335 is an illustration of a device to insert an object such as a flashlight on the outside or top of the hand between the thumb and index fingers, as illustrated by the drawings in that patent. The Peters patent addresses the placement of a flashlight on the top of the hand and is not concerned about securing a device to trigger a spray of mace or pepper spray toward an individual for protection purposes.

In this particular device the canister of mace or pepper spray is inserted in a pocket on the top of the hand surface in the approximate middle of the hand. A triggering mechanism built into the device allows the individual to discharge the mace or pepper spray and yet still allow the person to use his or her hand.

BRIEF SUMMARY OF THE INVENTION

This is a device, which will allow women an added level of protection particularly in those areas where a woman must walk alone in dimly or poorly lit areas. Some women carry individual cans of pepper spray or mace for their protection. Unfortunately, the individual can does not allow the woman to use both hands to defend herself if that situation arose.

This device will allow a woman to use both hands while using this device. It is simply slipped over the hand and adjusted using a means to fasten the device; a canister of pepper spray or mace is embedded in this device and will rest on top surface of the hand. The discharge aperture for the pepper spray or mace is positioned such that when the device is activated the spray will travel in a straight line away from the position of the hand. A triggering mechanism, which is embedded in the device, allows the individual to release the spray by squeezing a band, which is positioned across the palm of the hand.

In the event of an attack the woman can simply squeeze a bar or band on the underside of the device and the pepper spray or mace will be discharged from the aperture of the pepper spray or mace canister. The woman can aim the spray very effectively with this device. Individual canisters can be removed after use or if they lose their effectiveness.

A piece of fabric, plastic, or cloth, which runs from one side of the hand to the other or the underside of the palm is equipped with a triggering mechanism and is integral to the device. It is contemplated that a variety of triggering mechanisms may be employed to activate this device and discharge the contents of the embedded can. A strap allows the device to be attached to the person's hand but also allows adjustment of the device.

Although mace or pepper spray is specifically mentioned, other types of offensive material may be discharged.

An object of this device is to allow the woman to be protected but also allow her to be able to use her hand to defend herself.

Another object of this device is also for entertainment purposes. An appropriate canister may be inserted into the opening and a stream of string or webbing, for instance, may be discharged in the same type of device by simply removing and changing the canister.

This device may be slipped on and off the hand easily and will allow the individual to use the hand for other purposes such as opening a car door, using a cell phone, carrying groceries, etc.

Although one of the objects of the objects specifically mentions the protection of women, it may be used with any individual including those persons who may have disabilities or the elderly.

DETAILED DESCRIPTION OF THE EMBODIMENTS

Figure 2:
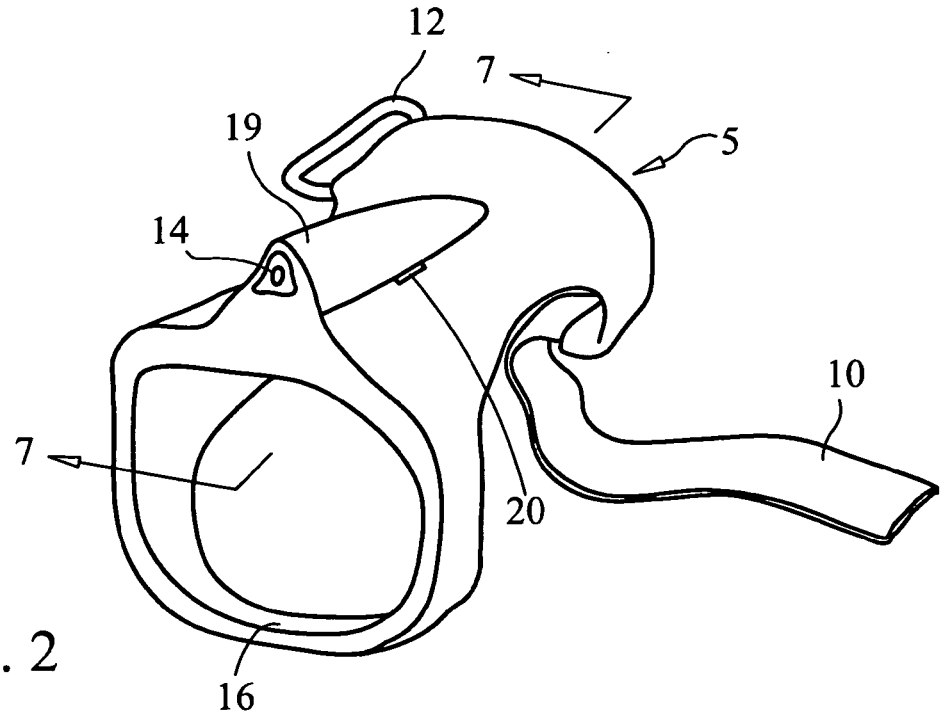
FIG. 2 is a perspective view of the device without the hand.
Figure 8:
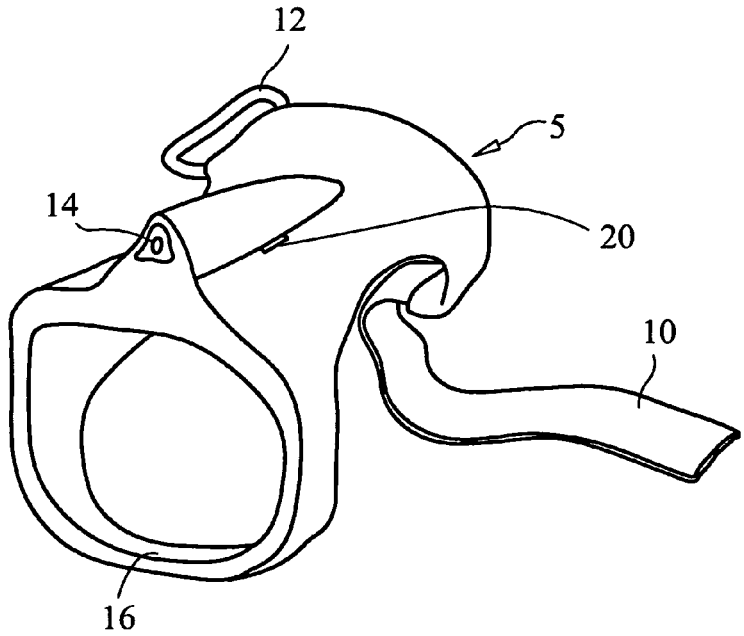
FIG. 8 is an isometric view of the device.

This glove device will enable any person but especially women or persons with physical disabilities or the elderly particularly in unlit or dimly lit areas to protect themselves. It is a device 5 which is slipped over the user's hand like a glove and is fastened across the wrist or lower part of the arm using an strap 10, which fits through a buckle and is equipped with a means to connect the respective ends of the strap. This means of connection may be a hook and loop assembly, snaps or buttons. FIGS. 2,8.

The device 5 is a single piece made from hard plastic or laminate. Other types of material may also be used but plastic would probably be preferred secondary to durability, wearability and cost considerations. It is probably preferable to make the device using a mold process.

Figure 9:
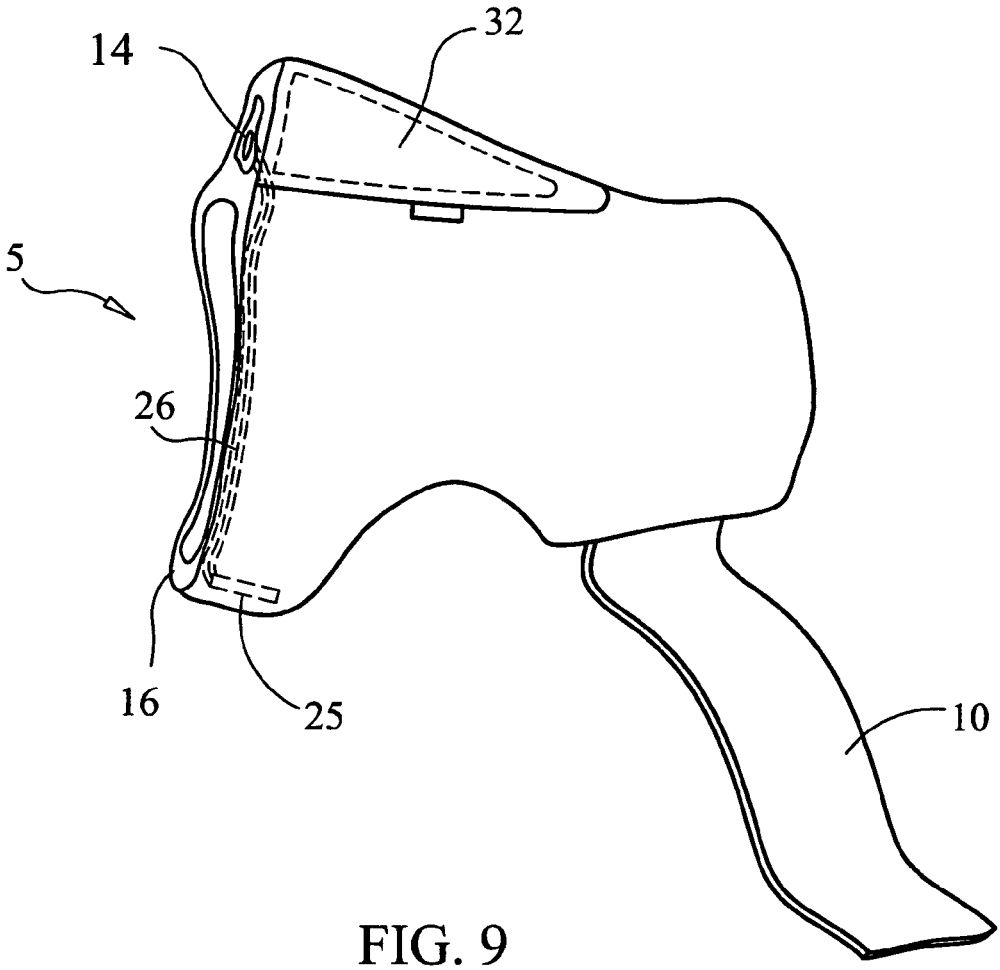
FIG. 9 is a side view indicating the cavity for the canister and the triggering mechanism.

On the top of the device 5 is a cavity 32 into which a canister of mace or pepper spray is inserted. FIG. 9 If the device is used for personal protection the canister is likely pepper spray, mace or some other offensive chemical but the device may also be used for entertainment purposes and the canister may include silly string ® or webbing or some other material. The hole on the canister of mace is aligned such that the discharge goes through the aperture 14 of the device 5.

For purposes of discussion the device will be used for personal protection and therefore many of the canister references will be for a can of pepper spray or mace. The particular can of pepper spray or mace is not being claimed; however, it is an essential part of this device.

Figure 1:
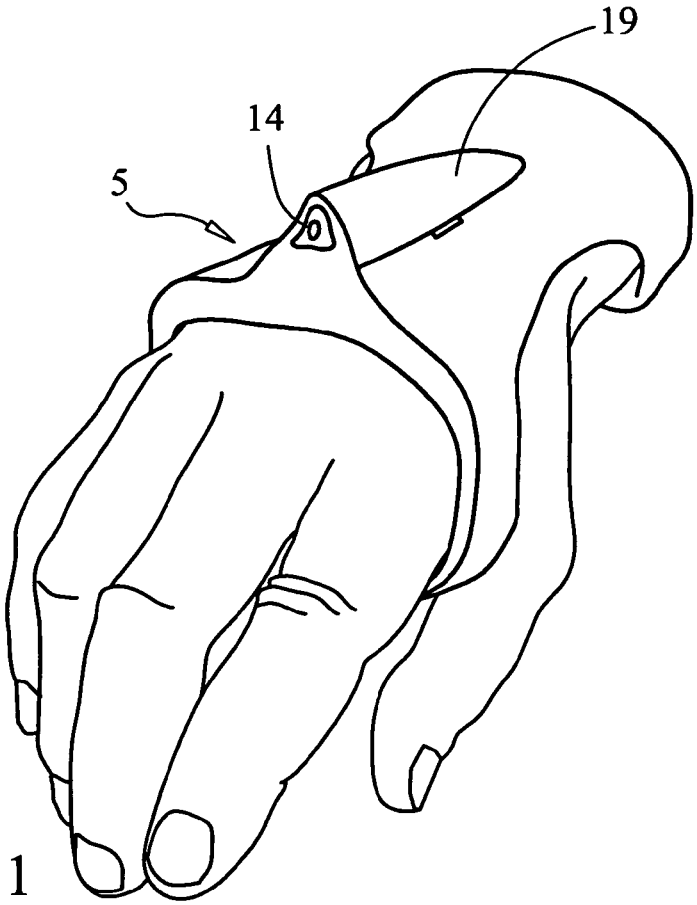
FIG. 1 is a perspective view of the device installed on an person's hand.
Figure 3:
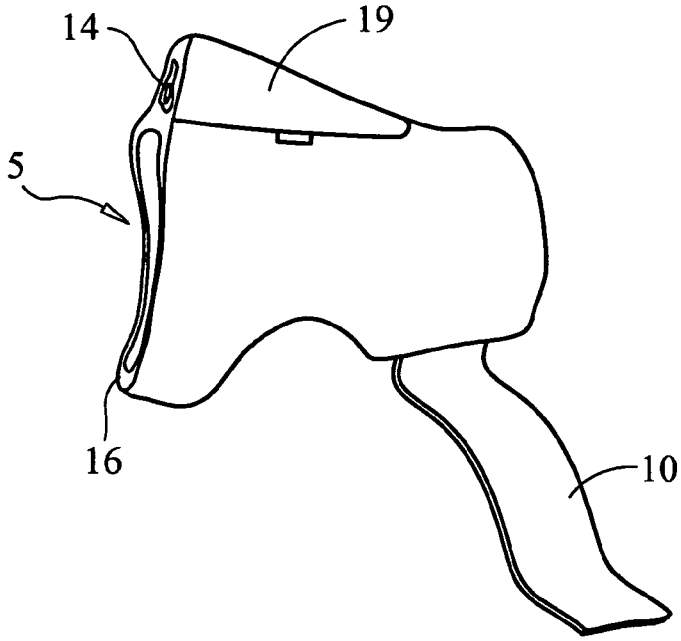
FIG. 3 is a side view of the device.
Figure 6:
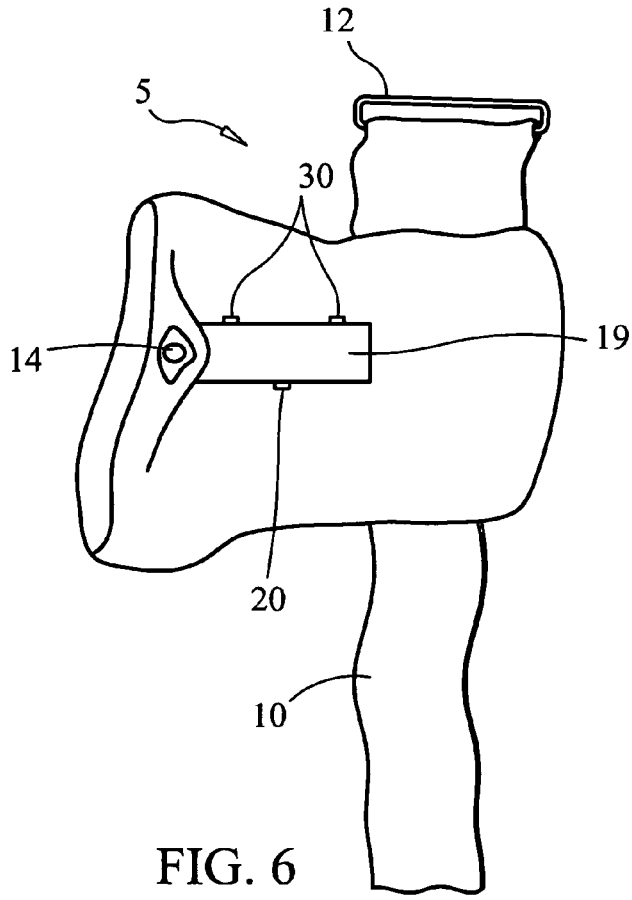
FIG. 6 is a top view of the device.

The can of mace or pepper spray is inserted into the chamber 32, which is located on the top of the device. FIG. 1 A means of access or cover 19 to replace the canister is provided. FIG. 3 It is contemplated that the cover 19 will have a means to secure the device on one side through the use of a latch or hasp 20 and be hinged 30 on the opposite side. FIGS. 3,6,8 The canister is designed such that the spray will be emitted from the canister in a generally straight stream through the aperture 14 which is provided. The aperture 14 would allow the contents of the can to be directed toward an individual or to "aim" the spray. FIGS. 3,4,6,7.

Figure 4:
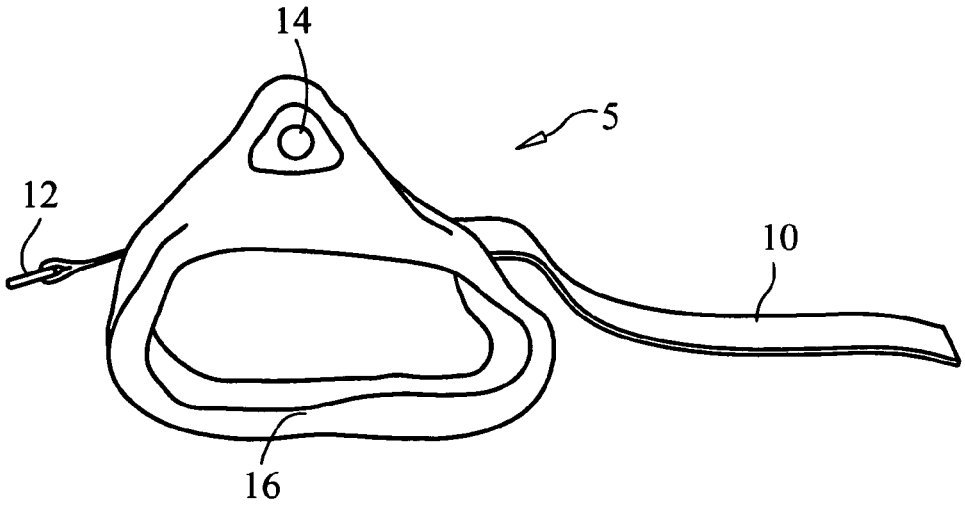
FIG. 4 is a front view of the device.
Figure 5:
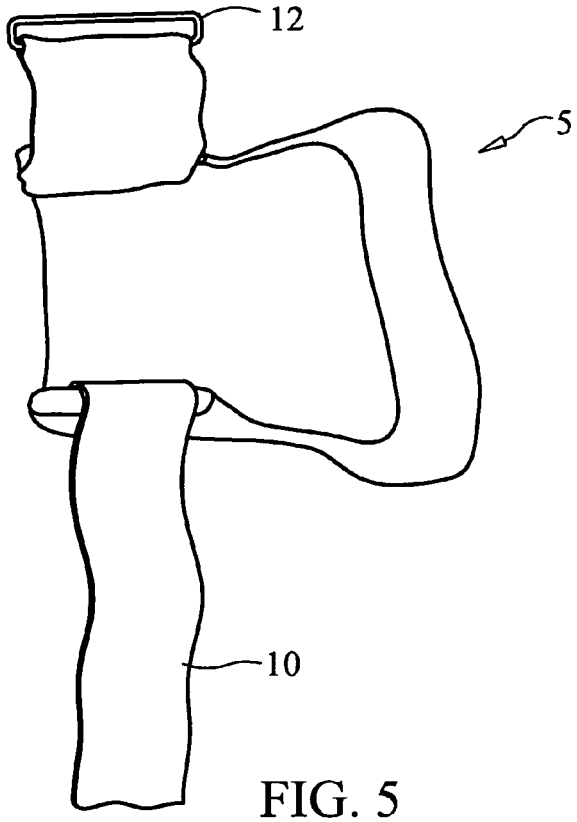
FIG. 5 is a bottom view of the device.

Between the top surface of the device and the bottom surface is a hollow section. FIGS. 1,2 A person's hand fits within the hollow space and the device 5 slides over the person's hand and is secured by a fastening mechanism. FIG. 1 The fastening mechanism can be a strap 10 which is inserted through a buckle 12 and adjusted to the size of a person's hand; it is preferable that the strap is equipped with a hook and loop assembly for ease of adjustment and fit. FIGS. 2,3,4 The fastening mechanism may also be buttons or snaps.

The bottom surface 16, which extends across the palm of the individual is partially hollow to insert a triggering mechanism 25 for the device 5. FIGS. 2,9 The triggering mechanism 25 may be a trip wire with mechanical linkage, a small balloon with appropriate mechanical linkage, or a radio frequency circuit. The bottom surface 16 should be made such that it can be easily squeezed by the individual to activate the triggering mechanism 25.

Figure 7:
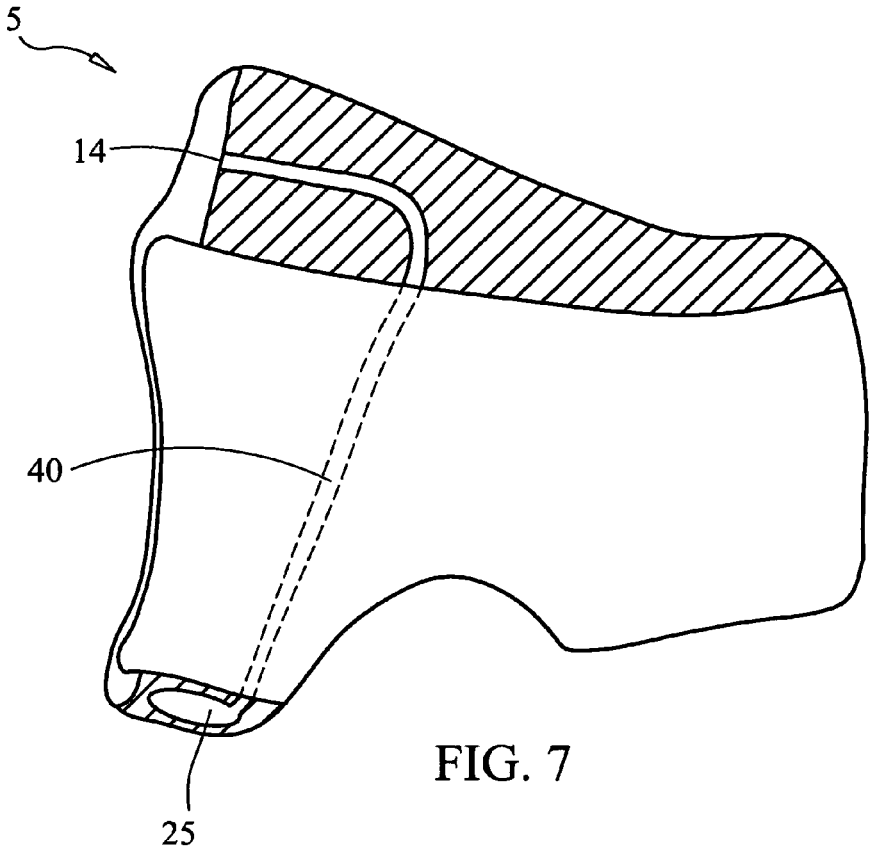
FIG. 7 is a cross sectional view of the device according to line 1—1 on FIG. 2.

When the bottom surface 16 is pressed the triggering mechanism 25 will activate and allow the contents of the canister to be discharged into an assailant's face through the aperture 14, which has been provided in the device 5. FIGS. 7,9 Because the speed of discharge of the contents of the can is paramount it may be preferable to employ a mechanical trigger in the form of a trip wire 26 for fast release. FIG. 9A channel 40 is provided between the triggering mechanism 25 and the release mechanism for the canister to protect the means to trigger the release of the contents of the can. FIG. 7 The triggering mechanism 25, as mentioned before, may include mechanical linkage 26, which will need to be protected from crimping or bending and this mechanical linkage 26 will be protected by placement with the channel 40. FIG. 9 The channel 40 is likely to be molded as part of the device during construction or manufacture of the device.

According to FIGS. 7 and 8, the bottom surface 16 traverses the entire surface of the palm. Once the bottom surface 16 is squeezed, it discharges the mace by use of the triggering mechanism 25 via the mechanical linkage 26.

This device 5 will allow the user of the device to be protected but also at the same time be able to use the hand, unlike prior art, which does not enable the user free access for both hands.

The canister of material can be changed by accessing the cavity 32 through means of the cover 19, which is on the top of the device.

While the embodiments of the invention have been disclosed, certain modifications may be made by those skilled in the art to modify the invention without departing from the spirit of the invention.

What is claimed is:

1. A glove for personal protection or entertainment, which is comprised of:

a. a single piece of material;

wherein the single piece has a top surface and a bottom surface;

wherein the top surface and the bottom surface are a connected piece;

b. a hollow section of predetermined diameter is placed between the top surface and the bottom surface;

wherein a person's hand fits within the hollow section;

c. a means to fasten the device to the person's hand;

d. a cavity;

wherein the cavity is of a predetermined dimensions to house a canister of predetermined size;

e. a means of access to the canister;

wherein the means of access to the cavity has a cover;

f. a triggering mechanism;

wherein the triggering mechanism has a first end and a second end and allows the release of the contents of the canister through an aperture through mechanical linkage between the triggering mechanism and the canister;

wherein a channel within the device between the top surface and bottom surface provides a means to protect the triggering mechanism;

g. an aperture;

wherein the canister is placed in the cavity on the top surface of the device;

wherein the opening in the canister aligns with the aperture of the device aperture to allow the discharge of the contents of the canister.

2. The means to fasten the device as described in claim 1 is a piece of material with a hook and loop assembly which is threaded through a buckle.

3. The means to fasten the device as described in claim 1 is a snap and button.

4. The triggering mechanism as described in claim 1 is a wire.

5. The triggering mechanism as described in claim 1 is a balloon.

6. The triggering mechanism as described in claim 1 is a radio frequency.

* * * * *